US006383432B1

(12) United States Patent
Nakajima et al.

(10) Patent No.: US 6,383,432 B1
(45) Date of Patent: May 7, 2002

(54) HIGH-SPEED APPARATUS AND METHOD FOR PRODUCING THERMOPLASTIC SYNTHETIC FIBERS

(75) Inventors: Sadaaki Nakajima; Taiju Terakawa; Kanemitsu Fuchigami; Masaru Nishijima, all of Shiga (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/488,782

(22) Filed: Jan. 21, 2000

(30) Foreign Application Priority Data

Jan. 22, 1999 (JP) ..... 11-014842

(51) Int. Cl.[7] ..... D01D 5/098; D01D 5/16

(52) U.S. Cl. ..... 264/210.7; 264/210.8; 425/66; 425/72.2; 425/296; 425/377; 425/403.1

(58) Field of Search ..... 425/66, 72.2, 131.5, 425/296, 325, 377, 403.1; 264/172.14, 172.15, 210.7, 210.8

(56) References Cited

U.S. PATENT DOCUMENTS 3,099,064 A * 7/1963 Haynes ..... 264/103
3,188,713 A * 6/1965 Dyer et al. ..... 28/273
3,380,131 A * 4/1968 Gray ..... 19/65 T
4,247,270 A * 1/1981 Schubert ..... 19/0.56
4,284,395 A * 8/1981 Kane ..... 425/66
5,079,812 A 1/1992 Sasaki et al. ..... 28/223
5,319,831 A 6/1994 Takehara ..... 28/263
5,411,693 A 5/1995 Wurst, Jr. ..... 264/171
5,750,151 A * 5/1998 Brignola et al. ..... 264/210.1

* cited by examiner

*Primary Examiner*—Nam Nguyen
*Assistant Examiner*—Joseph Leyson
(74) *Attorney, Agent, or Firm*—McDermott, Will & Emery

(57) ABSTRACT

A compact in-line high-speed apparatus and method for producing thermoplastic synthetic fibers includes a melt spinning device with a spinning block and a tow drawer; wherein the spinning block has at least one extruder, at least one spinneret block, and heating devices, and the tow drawer draws fibers spun from the spinning block as a bundled tow. Also provided is a drawn tow accumulating device equipped with at least two tow feeding rolls and a tow accumulating conveyer, wherein the tow feeding rolls feed the tow obtained from the tow drawer onto the tow accumulating conveyer, and the tow accumulating conveyer accumulates the tow fed from the tow feeding rolls. A high-speed tow stretching device is used for stretching tie tow supplied from the drawn tow accumulating device at high stretching speed.

10 Claims, 2 Drawing Sheets

HIGH-SPEED APPARATUS AND METHOD FOR PRODUCING THERMOPLASTIC SYNTHETIC FIBERS

FIELD OF THE INVENTION

This invention relates to an apparatus and a method for producing thermoplastic synthetic fibers, especially fibers used for non-woven fabrics or other garments. More specifically, it relates to a compact apparatus which can produce regular fibers, composite fibers and so on, continuously throughout from the melt spinning step to final fiber obtaining step with high speed. Furthermore specifically, it relates to an apparatus equipped with a melt spinning device, a tow drawer and a tow accumulating device, a high-speed tow stretching device, and so on, being arranged functionally according to sequential time-to-time processing steps of materials, applicable for producing a tow having a large fineness such as 10,000 dtex or more, and a producing method using the said apparatus.

DESCRIPTION OF THE RELATED ART

Generally, as apparatus for producing thermoplastic synthetic fibers, there have been two types of apparatus as roughly classified. The first is for producing continuous fibers (long fiber or filament) having a small amount of total fineness that are to be directly knitted (or woven) with a knitting machine or weaving machine, then processed into garments or the like. The second is for producing short fibers (staples) or a tow supplied as woven or non-woven fabrics produced through intermediate steps of spinning, carding, and so on.

In the case of said first apparatus for producing continuous fiber, total fineness of obtained fibers is small as 50–3000 dtex at most. As the first apparatus for producing continuous fibers, a high-speed apparatus so called "Spin-Draw-Texture type" is conventionally known, which spins fibers from its each spinneret, stretches the fibers at high speed, processes the fibers to be bulky, then winds the fibers on its winder. This apparatus is applicable for small fineness fibers such as previously mentioned. Accordingly, it is possible to produce continuous fibers at a high speed of 3,000–7,000 m/min. approximately. However, in the case of producing short fibers or tow using the first apparatus, it is necessary to set many paper tubes (bobbins of wound fibers) to creels after crimping process, then unwind the fibers as tows and be reprocessed. Thus it requires a widely extended area for device of creels, and it is uneconomical from the view point of operability or re-processing.

As the second type apparatus for producing short fibers or a tow, an apparatus so called "Short-Spin type" is conventionally known which arranges a melt spinning device equipped with a large-size spinneret in which many spinning holes are bored, a low-speed stretching device, and a stuffer type crimping processor. In the case of this Short-Spin type apparatus, unstretched fibers are spun at low speed from a large-size spinneret which approximately 3,000–50,000 spinning holes are bored, then stretched at a low speed of 30–150 m/min. to give a tow having a total fineness of approximately 500,000–2,500,000 dtex. In this apparatus, the size of the spinneret is large, and the density of the bored spinning holes is high, so that the distribution of raw resin inside the spinneret tends to be non-uniform, also the fineness of spun fibers tends to be non-uniform. Further in the case of producing composite fibers, where there is non-uniformity in the distribution for two kinds of thermoplastic resins, it is difficult to produce fibers having a uniform composite ratio with less eccentricity.

Further, in the case of producing fibers having small fineness, that is 3 dtex or less of single fiber fineness, breakage of single fiber or melting adhesion of each single fibers tend to occur.

Also in the case such as when spun fibers are wound on a stretching device, or when fine adjustment of the crimping processor is required, it is necessary to stop the apparatus as a whole including the spinning device, so that much thread is wasted, so it has been problem on this apparatus.

There has also been another conventional possibility to produce tow having large fineness by arranging an apparatus of the so called "Conventional Type" equipped with many relatively small spinneret blocks wherein the density of the bored spinning holes is low. However, because many spinnerets are required, the spinning block become long and large. Accordingly, it requires substantial effort to change each spinneret or check and maintain related equipment such as gear pumps for each spinneret, so that the operability of this apparatus becomes adversely effected. Further, this apparatus requires many cans for stocking unstretched tows so that a large area for operation is not required.

Japanese Patent Publication (Tokkyo Kokai Koho) Hei 7-216626 (corresponding to U.S. Pat. No. 5,411,693) discloses a Short-Spin type apparatus for producing composite fibers comprising a spinning block equipped with a large-size spinneret in which many spinning holes are bored, and a special quenching device for blowing high-speed air into the space just under the surface of the spinneret from one side. In this apparatus, the production speed is low because it is not equipped with a high-speed stretching device or high-speed crimping processor. Further, properties of each single fiber tend to become non-uniform, such as non-uniform fineness or non-uniform strength, causing localized cooling of the spinneret surface from high-speed quenching air stream. Also, the surface of the spinneret is easily cooled, so that it is difficult to keep spinability and uniform fiber properties for long periods. Furthermore, this apparatus also contains the same peculiar problem as the Sort-Spin Type as previously mentioned.

Japanese Patent Publication (Tokkyo. Kokai Koho) Hei 3-130407 (corresponding to U.S. Pat. No. 5,079,812) discloses an automatic tow exchanging apparatus for feeding a tow into a can, equipped with pairs of tow feeding rolls on the frontside and backside of the apparatus. This apparatus can make rapid exchange of the tow possible, but it is a type of feeding the tow into a can, so that it is impossible to produce the tow continuously from the spinning step, via the stretching step to the crimping step.

This invention aims to provide a fiber production apparatus, in which it is possible to produce fibers having large total fineness of approximately 10,000–440,000 dtex continuously from the melt spinning step to the final (e.g. crimping) step at high stretching speed approximately 300–6,000 m/min., and which has compact whole size. And it aims to provide a fiber production apparatus wherein the spinning block is easily checked and maintained. And it also aims to provide such apparatus having a means for stocking the tow temporarily. Further, it aims to provide a fiber production apparatus which can pass the fibers into the stretching step directly from the spinning step when the apparatus is continuously driven. Furthermore, it aims to be applicable for producing various kinds of fibers such as regular fibers or composite fibers. It further aims to solve the above mentioned problem existing in the continues Long fiber producing apparatus such as Spin-Draw-Texture type, or the short fiber producing apparatus such as Short Spin type and Conventional type.

SUMMARY OF THE INVENTION

To solve the above problem, this invention provides the following:

1. A compact in-line high-speed apparatus for producing thermoplastic synthetic fibers comprising;

a) a melt spinning device equipped with a spinning block and a tow drawer wherein the spinning block has at least one extruder, at least one spinneret block, and heating means, and the tow drawer draws fibers spun from the spinning block as a bundled tow;

b) a drawn tow accumulating device equipped with at least two tow feeding rolls and a tow accumulating conveyer, wherein the tow feeding rolls can feed the tow obtained from the tow drawer onto the tow accumulating conveyer, and the tow accumulating conveyer can accumulate the tow fed from the tow feeding rolls; and c) a high-speed tow stretching device stretching the tow supplied from the drawn tow accumulating device at high stretching speed.

2. The compact in-line high-speed apparatus for producing thermoplastic synthetic fibers according to the above article 1, further comprising a high-speed crimping processor next to the high-speed stretching device for crimping the stretched tow at high speed.

3. The compact in-line high-speed apparatus for producing thermoplastic synthetic fibers according to the above article 1, further comprising a tow cutter for cutting the stretched tow into short fibers as final products.

4. The compact in-line high-speed apparatus for producing thermoplastic synthetic fibers according to the above article 1, further comprising a tow winder or a tow box packing device for preparing the stretched tow as a final product.

5. The compact in-line high-speed apparatus for producing thermoplastic synthetic fibers according to the above article 1, wherein the drawn tow accumulating device is further equipped with a sensor detecting the accumulation state of the tow.

6. The compact in-line high speed apparatus for producing thermoplastic synthetic fibers according to the above article 1, wherein at least one of the tow feeding rolls is a pinch roll and at least one of the tow feeding rolls has a mechanism to take off from the tow passing route.

7. The compact in-line high speed apparatus for producing thermoplastic synthetic fibers according to the above article 1, wherein the melt spinning device is equipped with at least two extruders for producing multi-component thermoplastic synthetic conjugated fibers comprising at least two components.

8. The compact in-line high speed apparatus for producing thermoplastic synthetic fibers according to the above article 1, wherein the high-speed tow stretching device is equipped with a mechanism which can stretch a tow having a total fineness of 10,000–440,000 dtex at a spinning speed of 300–6,000 m/min.

9. The compact in-line high speed apparatus for producing thermoplastic synthetic fibers according to the above article 1, wherein the spinneret blocks are for spinning composite fibers having sheath-core or side-by-side configuration.

10. A method for producing thermoplastic synthetic fibers using the compact in-line high-speed apparatus for producing thermoplastic synthetic fibers according to the above article 1, characterized in supplying the tow fed from the tow feeding rolls directly to the tow stretching device, or taking at least one of the tow feeding rolls off from the tow passing route, in the high speed stretching step.

The "Compact in-line high speed apparatus for producing thermoplastic synthetic fibers" defined in this invention means an apparatus for thermoplastic synthetic fiber production which is equipped with devices for each process of melt spinning, tow drawing and accumulation, high-speed stretching, and optionally high-speed crimping, tow cutting and/or tow winding, along a time-to-time sequence into one continuous line, and processing raw material resins into final product of fibers (tow), at high speed.

BRIEF DESCRIPTION OF THE DRAWINGS

In FIG. 1, each symbol is as the following:

1: Melt spinning device, 2: Drawn tow accumulating device, 3: High-speed stretching device, 4: High speed crimping processor, 5: Dryer, 6: Tow cutter, 7: Tow winder, 8: Tow box packing device, 9: Spinning block, 10: Tow drawer, 11: Tow drawing rolls. 12: Tow drawer panel, 13: Oiling devices, 14: Hopper, 15: Extruder a, 16: Extruder b, 17: Transfer block a, 18: Transfer block b, 19: Gear pump a, 20: Gear pump b, 21: Gear pump driving motor a, 22: Gear pump driving motor b, 23: Assistant roll, 24: Quenching devices, 25: Spun fibers, 26: Guide roll of drawn tow accumulating device, 27: Drawn tow accumulating device panel, 28: Tow feeding rolls, 29: Tow accumulating conveyer, 30: Guide pinch rolls, 31: Tow accumulation sensor, 32: First set of stretching rolls, 33: Second set of stretching rolls, 34: Nipping roll type crimper, 35: Compressing chamber, 36: Dryer conveyer, 37: Stretching rolls, 38: Post-drying guide rolls, 39: Guide pinch rolls for packing tow, 40: Spinneret blocks, P: Unstretched tow, Q: Stretched tow, R: Crimped tow, S: Short fibers, Y: Direct tow passing route.

DETAILED DESCRIPTION OF THE PREFERRED EMBODIMENT

Figure 1:
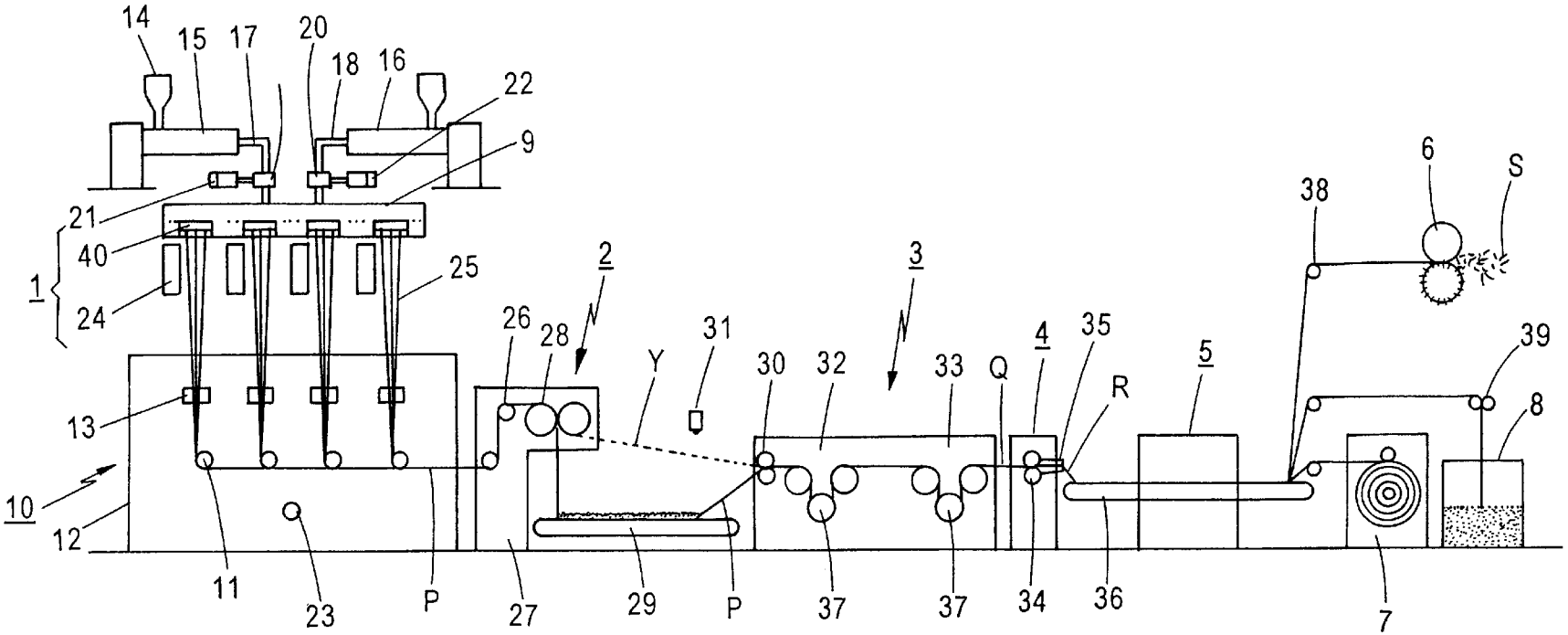
FIG. 1 shows a whole outlined front view of the apparatus of this invention.
Figure 2:
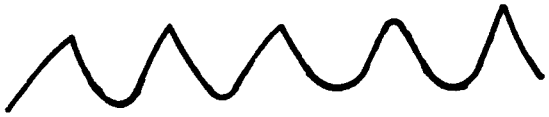
FIG. 2 shows a fiber having zigzag-shaped crimps.

This invention is explained based on an embodied example of an apparatus for producing bi-component composite fibers hereinafter. FIG. 1 shows an outlined front view of this embodied apparatus as a whole, for explaining this invention. In FIG. 1, the apparatus of this invention comprises three devices, roughly separated, which are the melt spinning device 1, the drawn tow accumulating device 2, and the high-speed stretching device 3. These devices are arranged compactly according to the sequential processing order. In this embodied example, it is possible to produce both kinds of short fibers (staples) and a tow (bundled long filaments), and also possible to produce both crimped and non-crimped fibers. Accordingly, this embodied apparatus is also equipped with optional devices such as the high-speed crimping processor 4, the tow cutter 6, the tow winder 7, the tow box packing device 8, and the tow dryer 5. The main component of the melt spinning device is installed at an upper level, and enables the spinning block 9 to spin fibers as four pre-bundled fibers per one spinning block at the same time. And the quenching devices 24 are installed just under the spinning block for cooling the spun fibers. Also the tow drawer 10 is installed further under the spinning block 9 for drawing and bundling the fibers spun from the spinning device 1 as a tow.

In FIG. 1, two extruders 15, 16 are installed at the upper level for melting and extruding thermoplastic resins. Beside the spinning block 9, transfer blocks 17, 18 are installed for transferring each melted resin extruded from the extruders 15, 16 into the spinning block 9. The spinning block is arranged under the deck of the upper level being fixed at a beam. Gear pumps (a, b) 19, 20 being driven by gear pump driving motors (a, b) 21, 22 are installed with the transferring blocks 17, 18, and each component of resin is measured and transferred into each spinneret block.

The spinning block 9 has four opening cavities in the same line for attaching spinneret blocks 40. In this embodied apparatus, the spinneret blocks 40 are attached with fastening bolts from downside. This spinning block forms a closed box, and has a heating means. The heating means can be any type such as a device heated with a liquid heating medium such as Dowtherm, a device circulating a heating medium of liquid or gas heated at outside, or a built-in metallic cast heater.

With regard to the plane shape of the spinning block 9 of this invention, it is sufficient if the shape of its cavity for attaching the spinneret matches the shape of the spinneret block, wherein the plane shape of circle, quadrangle, rectangle or oval can be used.

In this embodied example, used spinneret block 40 is for producing bi-component composite fibers, this block consists of main component members such as a cap functioning as an entrance for melted raw resin, a first distributing plate, a second distributing plate, a spinneret plate and flanges. The spinneret plate is set between flanges and fixed with bolts.

The apparatus of this embodied example comprises quenching devices under the spinneret blocks, wherein the number of the quenching devices is same as the number of the spinneret blocks, namely as the number of pre-bundled fibers. The type of quenching devices used in this embodied example blows cooling air from one side. In this invention, the quenching device(s) can be any of the out-in type and in-out type to blow cooling gas (air). Further, the apparatus of this invention can be equipped with quenching gas flow stabilizing ducts under the quenching devices. Furthermore, this invention may be equipped with no quenching device.

The melt spinning device of this embodied example comprises a tow drawer 10 equipped with oiling devices 13 which apply finish oil onto each pre-bundled fiber and tow drawing rolls 11 on a tow drawer panel 12 under the spinning block (FIG. 1). In the apparatus of this invention, the oiling device(s) can be any type as long as the finish oil can be applied onto the fibers 25. For example, an oiling device such as a box type flowing finish oil from its slit, or a spray type can be exemplified. As an addition to the tow drawer 10, an assistant roll 23 is equipped to be used for starting time of the spinning or for fiber breakage. As to the number of said assistant roll(s), it is sufficient that one assistant roll per 1–6 pre-bundled fiber(s) be provided.

The above oiling rolls, drawing rolls and assistant roll are connected to driving means.

The synthetic fibers producing apparatus of this embodied example comprises tow accumulating device 2 equipped with tow feeding rolls 28, and tow accumulating conveyer 29 accumulating the fed tow, before a stretching step, as shown in FIG. 1, at the left side of the tow stretching device 3. The end-part of tow accumulating conveyer 29 is located under the tow feeding rolls 28 (FIG. 1).

The tow feeding rolls 28 consist of a pair of pinch rolls of left and right sides, each roll being equipped with a driving motor (not shown in FIG. 1), and installed in a drawn tow accumulating device panel 27. Also the tow accumulating device 2 is equipped with 2 tow guide rolls 26 driven by motors (not shown in FIG. 1) at the entrance side of the tow.

This invention may further comprise a feeding chute equipped with a traversing device under the tow feeding rolls 28. In the case of equipping the traversing device, the tow is traversed between front and back sides in FIG. 1, and accumulated on the conveyer across the direction crossing the conveyer movement, and a large amount of tow can be accumulated. This conveyer is driven by a conveyer driving motor, and conveys a tow from the right to the left direction in FIG. 1. The accumulating device 2 functionally works by supplying the tow continuously to the next processing step of stretching. Additionally, the tow accumulating conveyer 29 can work functionally to stock the tow temporarily for tow hooking operation of starting time at low speed onto the high-speed stretching device of the next step. Also this temporal tow stocking function can be applicable for some occasional trouble in the following steps such as in the high-speed stretching device, the high-speed crimping processor, or the cutter, or for the case such as fiber stretching condition adjustment is required, without stopping the spinning operation.

The number of guide roll(s) 26 can be one to seven, generally two to five is suitable. These guide rolls work functionally to make fluttering tension of unstretched tow (P) supplied from the tow drawer 10 being constant, or to avoid the tow being wound on the tow feeding rolls. Also the guide rolls enable easy starting operation of tow feeding.

The tow feeding rolls 28 comprise a pair of flat rolls, a pair of grooved rolls of the gear type, or a combination of metal flat roll and rubber roll can be used. Among these, especially the pair of grooved metal rolls of gear type is preferably used, because the tow does not slip between nipping rolls and is not wound on the rolls, so that stable production of the tow can be continued for long time.

In the synthetic fibers producing apparatus of this invention, the tow feeding rolls 28 may have a mechanism which enables at least one of the tow feeding rolls taken off from the tow passing route (any of the left and the right roll, or both of them). This mechanism may be a means for removing one of, or both of the pair of tow feeding rolls into the direction of upside, downside, backside or frontside, to take the roll(s) off from the tow passing route. Applying this mechanism enables high-speed stretching of the tow directly supplied from the spinning step with the stretching device 3, without being accumulated on the conveyer 29.

According to this invention, it is possible to accumulate the tow on the conveyer 29 temporarily, stretching the tow with the high-speed stretching device 3, then increasing stretching speed step by step, afterward the tow is passed between the pair of tow feeding rolls, and processed directly for connecting to the high-speed stretching device 3, without being accumulated on the conveyer 29, as the broken line of the tow passing route Y shows in the FIG. 1. Thus the tow having the total fineness of 10,000 dtex or more can be stretched at the high speed of 1,000 m/min. or more.

The tow accumulating conveyer 29 can be made of any material such as a metal net, a synthetic resin net, a woven net combining metal and synthetic resin, an elastic material belt such as a rubber, or a cloth belt.

In this embodied example, a tow accumulation state detecting sensor 31 is installed above the tow accumulating conveyer. This sensor detects and analyzes the tow accumulation state with pre-installed means for image analysis, to control the tow accumulation state, increasing or decreasing the speed of the tow accumulating conveyer, or the speed of the stretching device. In this apparatus, the speed of the conveyer or the stretching device is controlled with either a command from the sensor or by manual operation.

The thermoplastic synthetic fibers producing apparatus of this invention comprises the high-speed stretching device ahead of the high-speed crimping processor (FIG. 1). In this invention, it is sufficient that the apparatus comprise a mechanism which enables it to stretch the tow having approximately 10,000–440,000 dtex of total fineness as after stretched at approximately 300–6,000 m/min. of stretching speed, for example a large horsepower driving motor. Namely, it is a device for high-speed stretching large fineness tow. Especially, it is preferable to use a device which enables the stretching tow to have approximately 10,000–400,000 dtex of total fineness after being stretched at approximately 1,000–5,000 m/min. of stretching speed. In this embodied example, there is used a compact stretching device combining the first set and the second set of stretching rolls, wherein each set of stretching rolls comprises three stretching rolls 37 having heating means.

The heating means for the stretching rolls is not limited as long as it enables heating at approximately 50–200° C. The heating means can be any of a dielectric heating type, a built-in cast heater type or a liquid heating medium type. Also, the state of the stretching rolls arrangement and the number of the stretching rolls are not limited. Further, a high-speed stretching device of Nelson's roll type can be used. Also, the stretching device 3 can change its driving speed both into approximately 5–100 m/min. of low-speed driving at stretching start time and approximately 300–6,000 m/min. of high-speed driving in running actual production.

In this embodied example, guide rolls 30 of the pinch roll type are installed on the entrance side of the first set of stretching rolls for guiding the tow properly into the stretching rolls. These guide rolls can be replaced by one grooved free roll. Also, any other kind of guiding device can be used instead of these rolls.

Furthermore, as the high-speed stretching device of the synthetic fibers producing apparatus of this invention, a box type stretching device having built-in stretching rolls or a chamber type stretching device equipped with one roll per one chamber can be used. Also a multi-step stretching device equipped with multiple stretching blocks having 4–10 stretching rolls per one stretching block can be used.

The high-speed stretching device 3 of this embodied example can control the amount of accumulated tow on the conveyer 29 as constant and can control stretching speed automatically based on a command from the tow accumulation sensor 31. Obviously, this stretching condition can also be controlled by manual operation. Also it is possible to stretch the tow fed directly from the tow feeding rolls 28 without accumulating the tow on the conveyer 29.

In the thermoplastic synthetic fibers producing apparatus of this invention, the high-speed crimping processor is arranged after the tow stretching device (FIG. 1). This high-speed crimping processor can be any type of device as long as it can crimp the large fineness tow at high speed. In this embodied example, a nipping roll type crimper 34 having a compressing chamber 35 is installed.

In this invention, a crimping processor of the so-called "Inscription in Ring Roll Type" described in the Japanese Tokkyo Kokai Koho "Hei4-308236" (incorporated herein by reference) can be used, which comprises a rotating large diameter ring roll and a rotating small diameter inner roll inscribed in the large ring roll and arranged to have small nipping clearance.

Further as the crimping processor, an air forcing type crimping processor can be used. The crimping processor of this type is forcing the tow into the processor with high pressure air to make the tow crimped. Heated forced air can be used. Usually the air used is heated at 80–200° C. with 0.15–1 MPa of pressure.

Figure 3:
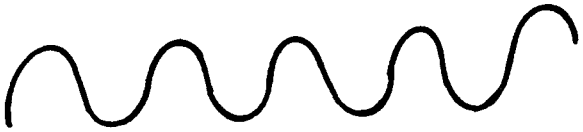
FIG. 3 shows a fiber having U-shaped crimps.
Figure 4:
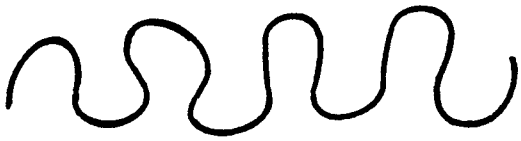
FIG. 4 shows a fiber having Ω-shaped crimps.
Figure 5:
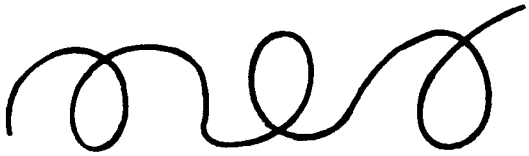
FIG. 5 shows a fiber having spiral crimps.

With the above crimping processor, short fibers or tow having crimp shown in FIG. 2, 3, 4 or 5 can be produced. In the case of processing regular fibers of the non-composite type or sheath-core composite fibers of non-eccentric type, fibers having zigzag crimps shown in FIG. 2 or U-shape crimps shown in FIG. 3 are obtained. In the case of processing side-by-side composite fibers or eccentric sheath-core composite fibers, fibers having Ω-shape crimps shown in FIG. 4 or spiral crimps shown in FIG. 3 are obtained. Of course, it is obvious that the shape of crimps will vary depending on production factors such as the nature of a single thermoplastic resin or two thermoplastic resins being combined, and/or the condition of spinning, stretching, or condition of thermal treatment after crimping.

According to this invention, it is also possible to produce substantially non-crimped fibers without using the high-speed crimping processor.

The embodied example of this invention is equipped with a dryer 5 having heating means for drying or annealing the tow between the high-speed crimping processor 4 and a tow cutter 6. In this case, a dryer conveyer 36 for drying and conveying the tow step by step is used as the heating means.

The thermoplastic synthetic fibers producing apparatus of this invention further is equipped with any one or more of a tow cutter 6, a tow winder 7, and a tow box packing device 8. The apparatus is also equipped with post-drying guide roll(s) 38 for guiding the tow into each process after drying. With these means, it is possible to produce any of the short fibers and the tow (FIG. 1).

The tow cutter can be any type as long as it can cut the tow at high speed. For example, it is possible to use any of type of cutter forcing a tow between a lower rotary having many blades and a upper rotary and cutting the tow by rotating the both rotaries (FIG. 1), and forcing a tow between a rotary having many blades and a pushing roll and cutting the tow by rotating the rotary.

The tow winder 7 can be any type as long as it can wind a tow having a large total fineness as discussed above. Instead of the tow winder, the tow box packing device 8 can be used.

The thermoplastic synthetic fibers producing apparatus of this invention arranges the devices for sequential time-to-time processing steps functionally and compactly, such as the melt spinning device 1, the drawn tow accumulating device 2, and the high-speed stretching device 3. In the embodied example of this invention, the high-speed stretching device 3 and the high-speed crimping processor 4 are arranged according to the right direction as shown in FIG. 1, however the arrangement direction of the post-spinning devices including the drawn tow accumulating device 2 is not limited as embodied herein.

Furthermore, any or all of the high-speed stretching device 3, the high-speed crimping processor 4, the dryer 5, the tow cutter 6 and the tow winder 7 may be arranged on the upper level.

The melt spinning device 1 of this embodied example exemplifies the spinning block 9 to which four spinneret blocks 40 can be attached per one spinning block, but it is possible to use a spinning block in which two to forty blocks can be attached. Also, the spinning block 9 can be a plurality of spinning blocks wherein two to six spinneret blocks can be attached per one spinning block. Also it is possible to use a spinning block in which the spinneret blocks are attached on the upside or horizontal side.

Using the thermoplastic synthetic fibers producing apparatus of this invention, it is possible to produce regular fibers made of a single thermoplastic resin or a mixture of plural thermoplastic resins, and composite fibers. In the case of producing composite fibers, it is possible to produce fibers having any composite configuration of a sheath-core configuration, an eccentric sheath-core configuration, a multiply splittable configuration, or a hollow multiply splittable configuration, a non-circular configuration. As a spinnable thermoplastic resin, a polyolefin resin such as a polypropylene, a high density polyethylene, a low density polyethylene, a linear low density polyethylene, and a copolymer containing two to four components of propylene as the main component and other α-olefin(s), a polyamide resin such as a nylon-6, and/or a nylon-66, a polyester resin such as a polyethylene terephthalate, a copolymer of polyethylene terephthalate-isophtalate, and a polybutylene terephthalate can be exemplified. Also a polyphenylene sulfide, a polystyrene, or a polyvinylidene fluoride can be exemplified.

In the case of composite fibers, it is possible to combine the thermoplastic resins suitably selected from the above mentioned resins. For example, possibly exemplified is a combination such as high density polyethylene/polypropylene, linear low density polyethylene polypropylene, linear low density polyethylene/polyethylene terephthalate, propylene-ethylene copolymer/polypropylene, propylene-ethylene-butene-1 copolymer/polypropylene, and high density polyethylene/polyethylene terephtalate.

EXAMPLE

Described herein is a production example of a sheath-core composite fiber wherein the sheath component is the high density polyethylene and the core component is the polypropylene, referring to FIG. 1. In addition to this example, the total fineness of the obtained fibers is 105,600 dtex as after stretched, and all processed from the composite fibers spinning, via the high-speed stretching and the high-speed crimping, to the short fiber cutting are continuously conducted, namely it is the in-line process.

Four sheath-core spinneret blocks were attached to the spinning block 9. This spinning block was heated at 280° C.

A high density polyethylene was melted and extruded from the extruder a 16 at a temperature of 240° C., and a polypropylene was melted and extruded from the extruder b 17 at a temperature of 300° C. Each melted resin was passed through each transfer block 17 and 18, and sent into the gear pumps of each component 19 and 20, then sent into the spinneret blocks being measured with the gear pumps, and sheath-core composite fibers were spun from the spinneret blocks. The spun fibers were immediately cooled by the quenching devices 24, a finish oil was uniformly applied onto the fibers with the oiling devices 13, then the four pre-bundled fibers were drawn with the tow drawing rolls 11 and bundled together as a tow P. This tow was sent to the two guide rolls 26 equipped to the drawn tow accumulating device 2, and nipped between the tow feeding rolls 28, then fed and accumulated on the tow accumulating conveyer 29 being traversed in the front and back sides direction by the tow feeding chute (not shown in FIG. 1) equipped under the tow feeding rolls, then conveyed and stocked in the right direction of the conveyer. The tow accumulation quantity was detected by the tow accumulation state detecting sensor 31, and analyzed by a means for image analysis, then the sensor sent a command for controlling the stretching speed to the high-speed stretching device of the next process, and the tow accumulation quantity on the conveyer was kept constant. In addition to this procedure, the sensor can also control the speed of the tow accumulating conveyer. However, in this example, the command was sent to the speed of the high-speed stretching device.

The tow P was sent to the guide rolls 30 having a pinch roll formation, then sent to the high-speed stretching device 3, and stretched at 110° C. of stretching temperature, at 3.2 times of stretching ratio, and at 2,000 m/min. of stretching speed. The total fineness of the stretched tow Q was 105,600 dtex.

The stretched tow was crimped with the high-speed crimping processor 4 to obtain a crimped tow R having 14 crimps/25 mm. The crimped tow R was sent to the dryer 5 with the dryer conveyer 36, and dried at 110° C., then sent to the tow cutter 6 passing through the post-drying guide roll 38 to obtain short fibers having 2.2 dtex of single fiber fineness and 51 mm of fiber length.

These composite fibers were produced continuously for six days, which shows that stable production is possible.

EFFECT OF THE INVENTION

The thermoplastic synthetic fibers producing apparatus of this invention is equipped with the drawn tow accumulating device 2, so that the apparatus of this invention does not require an extended area for stocking empty tow cans or tow cans filled with unstretched tow of fibers. Also the apparatus of this invention does not require a long and large area for the conveyer for conveying tow cans.

Also for this invention, operations manually done by operators are not required, such as moving tow cans nor hooking fibers onto many guides. Further, thread wastes do not come out at the starting time or the stopping time of the stretching.

Further in the apparatus of this invention, not only is the drawn tow accumulating device compactly arranged, but the entire apparatus including other devices such as the melt spinning device, the high-speed stretching device, and the high-speed crimping processor are compactly arranged, so that operability is good and the reduction of labor is possible. Furthermore, continuous high speed production is possible from the melt spinning process to the stretching process, and further to the crimping process.

Using the tow drawing and stretching device equipped to the apparatus of this invention, it is possible to accumulate large amounts of tow on the conveyer, so that operations such as changing the stretching condition and changing the crimping condition can be done without stopping the production line driving. Also this invention is applicable for temporally stopping each device after the stretching process so as to be checked and maintained. Also, the tow accumulated on the tow accumulating conveyer can be changed to be stretched while being sent from the tow feeding rolls directly to the stretching device, so that the entire apparatus is compact and easy to operate.

Because the tow accumulation sensor and the means for image analysis are equipped, so that the quantity of accumulated tow can be controlled with information from them, it is possible to drive the apparatus continuously for long periods. Also, the tow is stretched immediately after spinning, so that crystallization of the unstretched fibers due to long time storage does not occur. Accordingly, the fibers can be stretched uniformly without breakage.

Because the high-speed crimping processor is equipped for handling large fineness fibers at high speed, it is possible to drive the apparatus of this invention for long periods with high productivity. Further, the crimping processor of "Ring Roll" type further contributes to the long time driving, because checking and maintenance are easy.

The synthetic fibers producing apparatus of this invention further comprising the dryer, the tow cutter, the tow winder and the tow box packing device enables drying and annealing of the tow, and also enables producing any of the short fibers and the tow freely and continuously.

What is claimed is:

1. A compact in-line high-speed apparatus for producing thermoplastic synthetic fibers comprising:

a) a melt spinning device equipped with a spinning block and a tow drawer; wherein the spinning block has at least one extruder, at least one spinneret block, and heating means, and the tow drawer draws fibers spun from the spinning block as a bundled tow;

b) a drawn tow accumulating device equipped with at least two tow feeding rolls and a tow accumulating conveyer, wherein the tow feeding rolls feed the tow obtained from the tow drawer onto the tow accumulating conveyer, and the tow accumulating conveyer accumulates the tow fed from the tow feeding rolls; and c) a high-speed tow stretching device for stretching the tow supplied from the drawn tow accumulating device at high stretching speed.

2. The compact in-line high-speed apparatus for producing thermoplastic synthetic fibers according to claim 1, further comprising a high-speed crimping processor adjacent to the high-speed stretching device for crimping the stretched tow at high speed.

3. The compact in-line high-speed apparatus for producing thermoplastic synthetic fibers according to claim 1, further comprising a tow cutter for cutting the stretched tow into short fibers as final products.

4. The compact in-line high-speed apparatus for producing thermoplastic synthetic fibers according to claim 1, further comprising a tow winder or a tow box packing device for preparing the stretched tow as a final product.

5. The compact in-line high-speed apparatus for producing thermoplastic synthetic fibers according to claim 1, wherein the drawn tow accumulating device is further equipped with a sensor detecting the accumulation state of the tow.

6. The compact in-line high speed apparatus for producing thermoplastic synthetic fibers according to claim 1, wherein at least one of the tow feeding rolls is a pinch roll and at least one of the tow feeding rolls has a mechanism to take off from the tow passing route.

7. The compact in-line high speed apparatus for producing thermoplastic synthetic fibers according to claim 1, wherein the melt spinning device is equipped with at least two extruders for producing multi-component thermoplastic synthetic conjugated fibers comprising at least two components.

8. The compact in-line high speed apparatus for producing thermoplastic synthetic fibers according to claim 1, wherein the high-speed tow stretching device is equipped with a mechanism which stretches the tow having a total fineness of 10,000–440,000 dtex at a spinning speed of 300–6,000 m/min.

9. The compact in-line high speed apparatus for producing thermoplastic synthetic fibers according to claim 1, wherein the spinneret block spins composite fibers having sheath-core or side-by-side configurations.

10. A method for producing thermoplastic synthetic fibers using the compact in-line high-speed apparatus for producing thermoplastic synthetic fibers according to claim 1, characterized in supplying the tow fed from the tow feeding rolls directly to the tow stretching device, or taking at least one of the tow feeding rolls off from the tow passing route.

* * * * *